US006264433B1

(12) United States Patent
Spagnol

(10) Patent No.: US 6,264,433 B1
(45) Date of Patent: Jul. 24, 2001

(54) SPUTTER ION PUMP

(75) Inventor: Miriam Spagnol, Turin (IT)

(73) Assignee: Varian, Inc., Palo Alto, CA (US)

( * ) Notice: Subject to any disclaimer, the term of this patent is extended or adjusted under 35 U.S.C. 154(b) by 0 days.

(21) Appl. No.: 09/541,314

(22) Filed: Apr. 1, 2000

(30) Foreign Application Priority Data

Apr. 2, 1999 (IT) ..... TO99A0260

(51) Int. Cl.[7] ..... F04B 37/02; F04F 11/00
(52) U.S. Cl. ..... 417/48; 417/49
(58) Field of Search ..... 417/48, 49; 204/192.15; 310/62

(56) References Cited

U.S. PATENT DOCUMENTS

| | | | | |
|---|---|---|---|---|
| 3,319,875 | | 5/1967 | Jepsen . | |
| 3,994,625 | * | 11/1976 | Welch | 417/49 |
| 4,274,022 | * | 6/1981 | Elsel | 310/62 |
| 4,328,079 | * | 5/1982 | Hemmerich | 204/192.15 |
| 4,334,829 | * | 6/1982 | Harbaugh | 417/49 |
| 4,397,611 | * | 8/1983 | Wiesner et al. | 417/49 |
| 4,631,002 | | 12/1986 | Pierini . | |
| 5,980,212 | * | 11/1999 | Shen et al. | 417/49 |
| 6,004,104 | * | 12/1999 | Rutherford | 417/49 |

FOREIGN PATENT DOCUMENTS

| | | | | |
|---|---|---|---|---|
| 2365951 | * | 12/1976 | (DE) | H01J/41/20 |
| 5290792 | * | 11/1993 | (JP) | H01J/41/18 |
| 11354071 | * | 12/1999 | (JP) | H01J/41/12 |
| WO-00/57452 | * | 9/2000 | (WO) | H01J/41/20 |

OTHER PUBLICATIONS

Article by Hartwig et al., entitled "*A New Approach for Computing Diode Sputter–Ion Pump Characteristics*," published in *J. Vac. Sci. Technol.*, vol. 11, No.6 Nov./Dec. 1974, pp. 1154–1159.

* cited by examiner

*Primary Examiner*—Teresa Walberg
*Assistant Examiner*—Leonid M Fastovsky
(74) *Attorney, Agent, or Firm*—Bella Fishman

(57) ABSTRACT

A sputter ion pump incorporating a corrugated style anode comprising a plurality of cylindrical adjacent hollow cells provided with cross sections having substantially the same area and an arcuated perimeter.

11 Claims, 2 Drawing Sheets

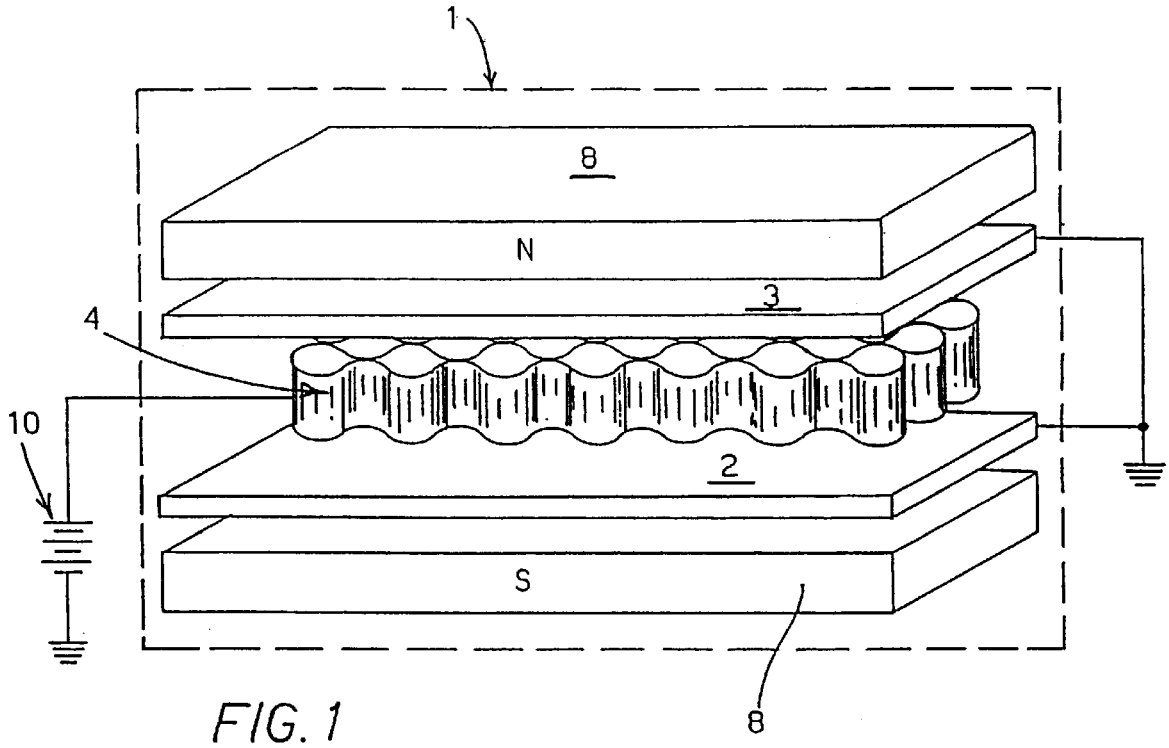
FIG. 1
FIG. 2
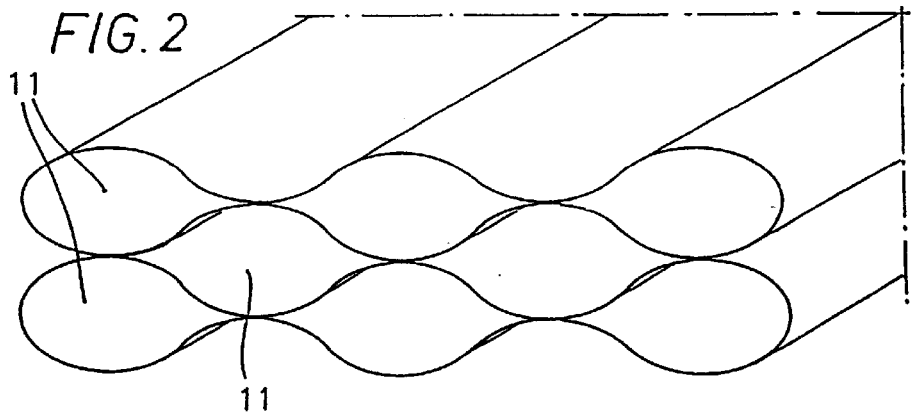
FIG. 3
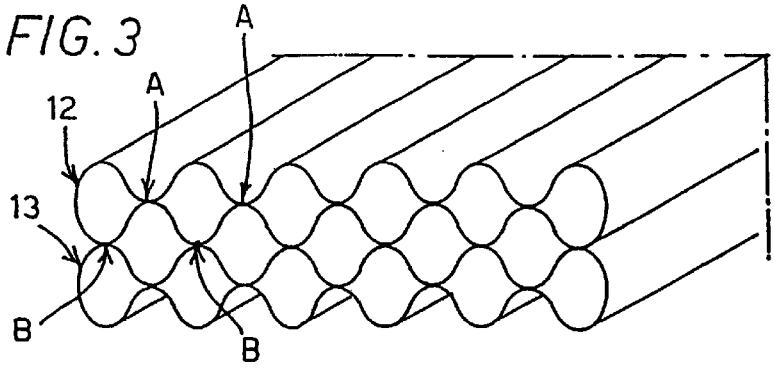

SPUTTER ION PUMP

FIELD OF THE INVENTION

The present invention relates to a sputter ion pump with an anode of improved structure. The invention further refers to a process for manufacturing such an anode.

BACKGROUND OF THE INVENTION

A sputter ion pump is a device for producing very high vacuum conditions. A conventional sputter ion pump comprises a vacuum envelope housing, at least one cathode electrode, an anode electrode formed as a plurality of hollow cylindrical cells, and means for applying to the anode a potential higher than that of the cathode. Sputter ion pump can be prvided with means for generating a magnetic field through the anode parallel to the axis of the cells.

In operation, when a potential is applied to the anode that is higher than the potential applied to the cathode, a region of intense electric field is produced between the cellular anode and the cathode that causes a breakdown of gas within the pump resulting in a glow discharge within the cellular anode, and between the anode and the cathode. This glow discharge results in positive ions being driven into the cathode electrode to produce dislodgment of reactive cathode material which is sputtered onto the nearby anode to produce gettering molecules in the gaseous stage coming in contact therewith. In this manner, the pressure within the vacuum envelope and, therefore, any container communicating therewith are evacuated.

To achieve an optimum operation of an ion pump operating at low pressures ($p<10^{-7}$ Torr) the anode cell radius R should be on the order of:

$$\frac{(30.3\times U)}{B\times(v_i/v_c)}\ \text{(cm)}$$

where U is the voltage in Volts applied between the cathode or cathodes and the anode of the pump, B is the strength of the magnetic field inside the pump in Gauss, $v_i/v_c$ is the ionization probability of an electron in a collision with a gas molecule ($v_i/v_c$~0.1 at pressures lower than $10^{-7}$ Torr) [*Vacuum Science and Technology*, Vol.11, No.6, November/December 1974].

Thus for an applied voltage of 5000 Volts and a magnetic field of 1150 Gauss, the radius R should be on the order of 1.07 cm.

Conventional anode cell structures are disclosed for example in the U.S. Pat. No. 4,631,002 issued to Pierini, and consist of a gathered cluster of cylindrical sectors. An array of cylindrical cells having radiuses equal or near equal to R leaves a number of inter-cylindrical cells having a generally triangular shape and a cross-section transverse dimension that is much smaller than R.

The typical diode sputter ion pumps display a class of instabilities that manifest as a mode shift phenomena following pump exposure to gas doses that are greater than the ultimate pressure of the vacuum system in which the pump is operating. Such mode shifting instabilities is disruptive to the devices to which the sputter ion pump is attached.

Irregular sputter-erosion patterns of the catode surface have been reported in diode sputter-ion pumps utilizing cylindrical cell anodes. Such irregular erosion are imputable to the inter-cylindrical cells and causes an increase of the pump dispersion current. The dispersion current effects are more evident when a pump has been used under high pressure conditions such as in electronic microscopes where the pump operation starts from high pressure levels.

Moreover, in general it is believed that mode instabilities may be caused by a loss of stability of the plasma in the oddly shaped inter-cylindrical cell of the anode structure. This arrangement might hinder a clean and quiet operation of the diode sputter ion pump.

A square anode cell pump that eliminates the intervening regions of a typical linked cylindrical cell design was suggested by Jepsen, as shown for example in the U.S. Pat. No. 3,319,875. Despite the advantage of having no intervening cell, the square cell anode design proved to be intrinsically inefficient. Moreover, the square cells have a larger area than that of a circle with radius R because of the presence of the peripheral comer areas.

It is an object of the present invention to provide a sputter ion pump provided with an anode electrode eliminating the above mentioned drawbacks of the prior art design.

SUMMARY OF THE INVENTION

According to the present invention a sputter ion pump has an anode structure positioned between a pair of spaced apart cathodes that are disposed withing an envelope housing. The anode strucutre comprises a plurality of hollow parallel to each other cylindrical cells with substantially the same cross sections. Each anode cell has acuated perimeter.

According to another embodiment of the present invention an anode structure comprises a plurality of external and internal hollow hexagonal adjacent cells parallel to each other, wherein each side of internal cells is shared with an adjacent cell. The anode structure for the ion pump of the present invention is manufactured by undulating a strip of metal, then folding the undulated strip so that the foled portions are in contact with each other along a first plurality of parallet lines. Then the folded portions are connected along a first plurality of parallel lines to form a row of closed aligned cells. Following this procedure one can form the requested number of rows of closed aligned cells and connect them therebetween so that to maximize transverse dimension of the anode cells.

These designs of ion pump allows for elimination of the inter-cylindrical small-size cells presented in the anode structure of the prior art while obtaining optimum areas for all the cells in the anode of the ion pump of the present invention.

BRIEF DESCRIPTION OF THE DRAWINGS

For a better understanding of the present invention reference is made to the accompanying drawings in which:

FIG. 1 is a schematic perspective view, partially in section, of an ion sputter ion pump incorporating an anode of improved design according to the present invention;

FIG. 2 is a fragmental perspective view showing a corrugated anode according to the present invention;

FIG. 3 illustrates a preferred method for manufacturing a corrugated anode according to the present invention.

DETAILED DESCRIPTION OF THE PREFERRED EMBODIMENTS

Figure 4:
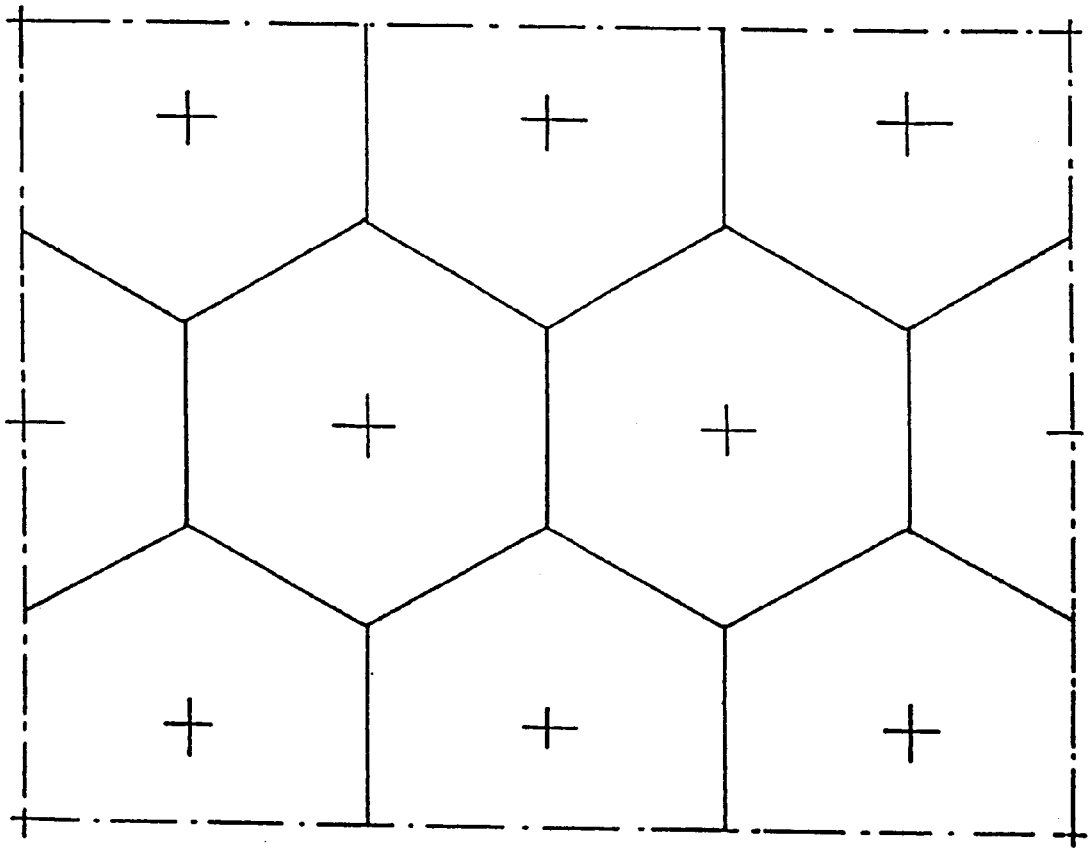
FIG. 4 shows a plan view of an anode portion according to an alternate embodiment of the invention.

Referring first to FIG. 1, a sputter ion pump comprises a sealed envelope 1 with two spaced apart cathodes 2, 3 positioned therein, and an anode 4 disposed between the cathodes 2 and 3 and having a plurality parallel to each other hollow cylindrical cells.

The cathodes 2, 3 and the anode 4 are sandwiched between means for generating a magnetic field, in the space between the anode and the cathodes such as a magnet 8.

A battery 10 schematically represents means for applying to the anode a positive potential while a lower potential (preferably the ground potential for safety reason) is applied to the cathodes. The cathodes are made of getter material so as to achieve the sputtering effect.

An anode design of the sputter ion pump in accordance with the present invention is schematically shown in FIG. 2 and comprises a plurality of adjacent cylindrical cells 11 parallel to each other and provided with cross sections having substantially the same area and an arcuated perimeter.

The cell dimensions are similar to those anode cell dimensions of a typical cylindrical cell anode design, yet without the intervening inter-cylindrical cells. As shown in FIGS. 2 and 3, the anode arrangement according to the invention is formed in a corrugated pattern, resembling the structure of cardboard packaging material, so that each cell has a regular size and shape, without any intervening cells.

The dimensions of the cell of the corrugated anode are to be such that the transverse area A of each cell overlaps that of the circle of radius R and is comprised between that of a circle having radius equal to R ($R^2$) and that of a square with a side equal to 2R ($4R^2$), where:

$$R = \frac{(30.3 \times U)}{B \times (v_i / v_c)} \text{ (cm)}$$

where U is the voltage in Volts applied between the cathode (s) and the anode of the pump, B is the strength of the magnetic field inside the pump in Gauss, $v_i/v_c$ is the ionization probability of an electron in a collision with a gas molecule ($v_i$/vc~0.1 at pressures lower than $10^{-7}$ Torr).

According to another embodiment of the invention, the perimeter of the cell is comprised between 2R and 4R so as to obtain a minimum cell inner surface.

According to a presently considered preferred embodiment of the invention, the corrugated style anode element can be made by forming a strip or band material 12 as shown in FIG. 3 and then by welding the shaped strip at the contact points A. A formed row of cylindrical aligned cells, are welded to similar rows 13, at points B. All the cells have substantially the same cross-sectional area.

More generally, the anode is formed by folding in two a metal strip, transversely to its longitudinal direction, and by locally arcuating or undulating the folded strip, so that the folded portions come to contact each other along a number of parallel lines, and then welding the two portions along such contact lines. Two or more of such folded and welded strips are then welded together along parallel lines transverse to the strip longitudinal direction.

An alternate embodiment of the invention is shown in FIG. 4 and comprises hexagonal adjacent cells, with a side of each cell being shared in common with an adjacent cell, but for the anode peripheral cells.

Sputter ion pumps equipped with an anode according to the invention have shown a reduction of the pump current instability that is believed to be due to the elimination of the inter-cylindrical cells while simultaneously maintaining a high discharge efficiency by ensuring that the area and shape of each cell approximate as much as possible that of the circle of optimum radius R.

What is claimed is:

1. A sputter ion pump comprising:

an envelope housing (1);

two spaced apart cathodes (2, 3) made of getter material;

an anode (4) disposed between said cathodes, said anode having a plurality of hollow cylindrical cells parallel to each other, each said cell of said plurality having substantially the same cross section and an arcuated perimeter; and means for generating a magnetic field through said anode parallel to an axis of each said cell.

2. The sputter ion pump of claim 1, wherein said cells have a transverse area A overlapping that of a circle of radius R, said transverse area A is in a range $\pi R^2 < A < 4R^2$, and $$R = \frac{(30.3 \times U)}{B \times (v_i / v_c)} \text{ (cm), where}$$

U is the voltage in Volts applied between said cathodes and said anode, B is a strength of the magnetic field inside the sputter pump in Gauss, and $v_i/v_c$~0.1.

3. The sputter ion pump of claim 2, wherein the perimeter of each said cell is in a range between $2\pi R$ and 4R.

4. A sputter ion pump comprising:

an envelope housing (1);

a pair of spaced cathodes (2, 3) made of getter material;

an anode (4) disposed between said cathodes, said anode having a plurality of hollow hexagonal adjacentexternal and internal cells parallel to each other, each side of said internal cells being shared with an adjacent thereto cell; and means for generating a magnetic field through the anode parallel to an axis of each said cell.

5. The sputter ion pump of claim 4, wherein said cells have a transverse area A overlapping that of a circle of radius R, said transverse area A is in a range $\pi R^2 < A < 4R^2$, $$R = \frac{(30.3 \times U)}{B \times (v_i / v_c)} \text{ (cm), where}$$

U is the voltage in Volts applied between said cathodes and said anode, B is a strength of the magnetic field inside the sputter pump in Gauss, and $v_i/v_c$~0.1.

6. A sputter ion pump as claimed in claim 5, wherein the perimeter of each cell is comprised between $2\pi R$ and 4R.

7. A method for manufacturing an anode for a sputter ion pump comprising the steps of:

providing at least one strip of metal;

undulating said at least one strip of metal; and forming at least one row of closed aligned cells by folding said undulated strip to obtain two folded portions being in contact therebetween along a first plurality of parallel lines.

8. The method for manufacturing an anode of claim 7, further comprising the steps of forming at least one additional row of closed aligned cells, and connecting said at least one row and said at least one additional row along a second plurality of parallel lines.

9. The method for manufacturing an anode of claim 8, wherein said step of undulating said strip of metal further comprising the step of welding said two folded portions along said first plurality of parallel lines, and step of forming at least one additional row further comprising the step of welding said at least one row and at least one additional row along said second pluarality of parallel lines.

10. The method for manufacturing an anode of claim 9, wherein said cells have substantially the same cross sections and arcuated perimeters.

11. The method for manufacturing an anode of claim 10, wherein said cells are formed as hollow hexagonal adjacent external and internal cells, each side of said internal cells is shared with an adjacent thetheto cell.

* * * * *